US010006280B2

(12) United States Patent
Logan et al.

(10) Patent No.: US 10,006,280 B2
(45) Date of Patent: Jun. 26, 2018

(54) DOWNHOLE POCKET ELECTRONICS

(71) Applicant: EVOLUTION ENGINEERING INC., Calgary (CA)

(72) Inventors: Aaron W. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 273 days.

(21) Appl. No.: 14/894,327

(22) PCT Filed: May 30, 2014

(86) PCT No.: PCT/CA2014/050505

§ 371 (c)(1),
(2) Date: Nov. 25, 2015

(87) PCT Pub. No.: WO2014/190439

PCT Pub. Date: Dec. 4, 2014

(65) Prior Publication Data

US 2016/0130932 A1 May 12, 2016

Related U.S. Application Data

(60) Provisional application No. 61/829,966, filed on May 31, 2013.

(51) Int. Cl.
*E21B 47/01* (2012.01)
*E21B 17/00* (2006.01)

(52) U.S. Cl.
CPC ..... *E21B 47/011* (2013.01); *E21B 17/003* (2013.01)

(58) Field of Classification Search
CPC ..... E21B 47/00; E21B 47/011; E21B 17/003; E21B 17/006
(Continued)

(56) References Cited

U.S. PATENT DOCUMENTS 3,968,473 A 7/1976 Patton et al.
4,884,071 A 11/1989 Howard
(Continued)

FOREIGN PATENT DOCUMENTS

CA 2351640 A1 5/2000
CA 2565898 A1 6/2004
(Continued)

OTHER PUBLICATIONS

CPS Catalog—Introduction, downloaded from http://www.halliburton.com/public/cps/contents/Books_and_Catalogs/web/CPSCatalog/01_Introduction.pdf on May 23, 2014.

*Primary Examiner* — Robert E Fuller
*Assistant Examiner* — David Carroll
(74) *Attorney, Agent, or Firm* — Oyen Wiggs Green & Mutala LLP

(57) ABSTRACT

An assembly for use in subsurface drilling includes a drill collar section having a bore extending longitudinally through an inner surface of the drill collar section. A pocket is formed in a section of the inner surface of the drill collar section. A holster is located in the pocket and a sleeve is snuggly fitted inside the bore in order to secure the holster inside the pocket. The sleeve may be sealed to the drill collar section for example by seals such as O-rings such that the holster is sealed from the bore. O-rings may be located on one or both of the inside of the inner surface of the collar or on the outside of the sleeve.

28 Claims, 17 Drawing Sheets

(58) Field of Classification Search
USPC ..... 175/325.5, 325.6, 325.7; 160/250.11
See application file for complete search history.

(56) References Cited

U.S. PATENT DOCUMENTS

| | | | |
|---|---|---|---|
| 5,740,860 | A | 4/1998 | Crawford et al. |
| 6,158,529 | A | 12/2000 | Dorel |
| 6,288,548 | B1 | 9/2001 | Thompson et al. |
| 6,300,624 | B1 | 10/2001 | Yoo et al. |
| 6,666,285 | B2 | 12/2003 | Jones et al. |
| 6,909,666 | B2 | 6/2005 | Dubinsky et al. |
| 6,927,390 | B2 | 8/2005 | Mickael |
| 6,942,043 | B2 | 9/2005 | Kurkoski |
| 6,944,548 | B2 | 9/2005 | Radtke et al. |
| 6,975,243 | B2 | 12/2005 | Clark et al. |
| 7,178,607 | B2 | 2/2007 | Mayes |
| 7,285,772 | B2 | 10/2007 | Labous et al. |
| 7,411,517 | B2 | 8/2008 | Flanagan |
| 7,497,254 | B2 | 3/2009 | Hall et al. |
| 7,566,235 | B2 | 7/2009 | Bottos et al. |
| 7,685,732 | B2 | 3/2010 | Davies et al. |
| 7,897,915 | B2 | 3/2011 | Hall et al. |
| 8,069,931 | B2 | 12/2011 | Hooks et al. |
| 8,225,868 | B2 | 7/2012 | Morley et al. |
| 8,400,160 | B2 | 3/2013 | Fredette et al. |
| 8,407,006 | B2 | 3/2013 | Gleitman |
| 8,519,865 | B2 | 8/2013 | Hall et al. |
| 8,704,677 | B2 | 4/2014 | Prammer |
| 2010/0032210 | A1 | 2/2010 | Teodorescu et al. |
| 2012/0055710 | A1* | 3/2012 | Herrera ..... E21B 47/01 175/41 |
| 2012/0061559 | A1 | 3/2012 | Ortiz et al. |
| 2012/0085583 | A1 | 4/2012 | Logan et al. |
| 2012/0096935 | A1 | 4/2012 | Finke et al. |
| 2013/0105222 | A1 | 5/2013 | Pate |
| 2013/0105678 | A1 | 5/2013 | Wilson et al. |
| 2013/0120154 | A1 | 5/2013 | Gleitman |
| 2014/0096620 | A1* | 4/2014 | Perrin ..... G01L 1/26 73/862.06 |

FOREIGN PATENT DOCUMENTS

| | | | |
|---|---|---|---|
| CA | 2502154 | A1 | 10/2005 |
| CA | 2570344 | C | 12/2005 |
| CA | 2706861 | A1 | 5/2006 |
| CA | 2549588 | A1 | 12/2006 |
| CA | 2699023 | A1 | 10/2010 |
| CN | 201714378 | U | 1/2011 |
| GB | 2196410 | A | 4/1988 |
| GB | 2470286 | B | 4/2013 |
| WO | 2005124397 | A1 | 12/2005 |
| WO | 2008112331 | A1 | 9/2008 |
| WO | 2008116077 | A2 | 9/2008 |
| WO | 2012164513 | A2 | 12/2012 |

* cited by examiner

DOWNHOLE POCKET ELECTRONICS

CROSS-REFERENCE TO RELATED APPLICATIONS

This application claims priority from U.S. Application No. 61/829,966 filed 31 May 2013. For purposes of the United States, this application claims the benefit under 35 U.S.C. § 119 of U.S. Application No. 61/829,966 filed 31 May 2013 and entitled DOWNHOLE POCKET ELECTRONICS which is hereby incorporated herein by reference for all purposes.

TECHNICAL FIELD

This invention relates to subsurface drilling, more specifically to systems for supporting downhole electronics and electromechanical equipment. Some embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at the surface.

Bottom hole assembly (BHA) is the name given to the equipment at the terminal end of a drill string. In addition to a drill bit a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars, pulsers and the like. The BHA is typically advanced into the wellbore by a string of metallic tubulars (drill pipe).

Modern drilling systems may include any of a wide range of electronics systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation, data acquisition, measuring properties of the surrounding geological formations (e.g. well logging), measuring downhole conditions as drilling progresses, controlling downhole equipment, monitoring status of downhole equipment, measuring properties of downhole fluids and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids, etc. Some downhole probes are highly specialized and expensive.

Various radioactive elements occur naturally in the earth. Different types of geological formations typically contain different amounts of such radioactive elements and therefore emit different amounts and different spectra of natural gamma radiation. Measuring gamma-radiation with a detector located inside a downhole probe within a borehole is a common operation in well logging. Natural gamma-rays are emitted when materials such as thorium, uranium and potassium (Th, U, K) undergo radioactive decay. Each element emits gamma-radiation at characteristic energies resulting in a characteristic gamma radiation spectrum . Measuring natural gamma-radiation is particularly useful in exploiting oil and gas resources because it is believed that the concentrations of Th, U, K taken individually or in combination are a good indication as to the characteristics of formations surrounding the borehole which may affect the availability for extraction of hydrocarbons. Such characteristics may include, for example, the presence, type, and volume of shale or clay.

Gamma-radiation is attenuated in passing through the walls of a drill collar. Therefore, the sensitivity of a gamma-radiation detector located inside a downhole probe within a drill collar is reduced. Another source of attenuation for gamma-radiation measurements is drilling fluid surrounding the downhole probe.

Downhole conditions can be harsh. Exposure to these harsh conditions, which can include vibrations, turbulence and pulsations in the flow of drilling fluid, shocks, and immersion in various drilling fluids at high pressures can shorten the lifespan of downhole probes and can cause failure of the electronics and electromechanical systems housed within downhole probes.

The following references describe technology that may be of interest to those reading this disclosure:

U.S. Pat. No. 6,300,624;
U.S. Pat. No. 6,666,285;
U.S. Pat. No. 6,944,548;
U.S. Pat. No. 6,975,243;
U.S. Pat. No. 7,566,235;
U.S. Pat. No. 7,685,732;
U.S. Pat. No. 7,897,915;
US 2013/0105678;
CA 2549588;
CA 2565898;
CA 2706861;
WO 2008/112331; and,
WO 2008/116077.

There remains a need for cost-effective and easily serviceable ways to house electronics and electromechanical systems in downhole drilling operations, which may include gamma-radiation detectors and other electronics systems of a wide range of types. There is also a continual need to provide alternative systems for downhole gamma-radiation measurement.

SUMMARY

The invention has a number of aspects. One aspect provides downhole apparatus that includes an electronics package removably insertable into a pocket formed inside a section of a drilling collar and supported by a retainer. The retainer may be in the form of a sleeve with a longitudinal bore. Other aspects of the invention provide an electronics package in the form of a holster configured to receive one or more housings containing electronics and/or electromechanical systems. Other aspects of the invention provide drill string components configured for receiving electronics packages. In an example embodiment, a drill string component has a tubular body. One or more radially-extending pockets are formed in the wall of a bore of the tubular body. The pockets are dimensioned and shaped to receive electronics packages which may be inserted into the pockets by way of the bore. A retainer is provided to keep the electronics package(s) in the respective pocket(s). The retainer comprises a tubular sleeve in some embodiments.

One example aspect of the invention provides a downhole assembly comprising a drill collar section having a bore extending longitudinally through it. A pocket is formed in an inner surface of the bore. An electronics package is removably disposed in the pocket. A sleeve is snugly fitted inside the bore. The sleeve secures the electronics package inside the pocket. The shape of the electronics package may be complementary to the shape of the pocket. For example, the pocket may have an arcuate outer face, the electronics package may have an arcuate convex outer side matching the outer face of the pocket and an arcuate concave inner side matching a profile of the sleeve. The pocket may optionally be lined with vibration damping material. The electronics package may optionally be coated with vibration damping material. The width of the electronics package is less than the inner diameter of the collar bore so that the electronics package can be slid into the bore and maneuvered while inside the bore to move radially outward into the pocket. The electronics package may comprise a holster having one or more compartments for housing electronics and sensors or detection equipment such as gamma-radiation detectors.

Suitable seals such as O-rings may be provided upstream and downstream of the pocket to prevent drilling fluid from reaching the electronics package.

Another aspect of the invention provides a downhole assembly in which a gamma radiation detector is mounted in a pocket within a wall of a drill collar or other drill string section. The pocket opens to a bore of the drill collar. The wall of the collar is thinner on the radial outward side of the pocket than it is in other radial directions that do not pass through the pocket. In some embodiments the radially outer wall of the pocket follows an arc centred on a centreline of the drill collar. In some embodiments the radially outward wall of the pocket has a uniform thickness. In some embodiments the gamma radiation detector is in an electronics package that is removably mounted in the pocket. In an example embodiment the gamma radiation detector is provided in a holster inside a pocket, which is formed in the inner surface of the drill collar, and a sleeve secures the holster inside the pocket. Gamma shielding may optionally be provided to enhance the directionality of the gamma radiation detector. For example, such shielding may be provided by making the sleeve from heavy density material to act as a shield against gamma-radiation incident from the rear side of the collar and/or providing one or more layers of radiation attenuating material on or in the holster facing the sleeve and/or providing one or more layers of radiation attenuating material located on a back side of the gamma radiation detector on or in the collar.

In some embodiments the retainer includes electrical contacts and the electronics package is in electrical communication with a telemetry tool and/or one or more other downhole electronic systems by way of the electrical contacts. For example, data may be communicated by the electronics package to a telemetry system through conductors in the retainer. In some embodiments the telemetry system is in a probe supported in a bore of the drill collar.

In an example embodiment, conducting springs supported on an inner surface of the holster are aligned to contact corresponding electrical conducting bands on an outer surface of the sleeve such that when the sleeve secures the holster inside the pocket, the electrically conducting springs are aligned with and make electrical connections with the electrically conducting bands.

Another aspect of the invention provides a downhole assembly comprising a section having a coupling for coupling the section onto a drill string and a bore extending through the section. A sleeve is insertable into the bore and is sealed at first and second longitudinally spaced-apart locations. A compartment for receiving an electronics package is provided between the sleeve and an outer wall of the section. A radially outermost wall of the compartment may have an arcuate profile concentric with the section.

Another aspect of the invention provides a holster for housing downhole electronics, the holster includes a longitudinal section having a smaller-radius concave inner surface and a larger-radius convex outer surface. The holster may be used in directional drilling operations or other types of drilling operations. The holster may comprise one or more compartments for housing electronics. In some example embodiments, each of the compartments is configured to receive a cylindrical tube which may house electronics (e.g. detectors, control systems, telemetry systems, well logging systems, etc.). For example, a gamma-radiation detector may be housed inside one of the compartments. The holster may be made, for example, from metal, plastic, thermoplastic, elastomers or rubber. The concave upper surface of the holster may optionally be made from or include a layer of a high density material to act as a shield against gamma-radiation.

Further aspects of the invention and non-limiting example embodiments of the invention are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
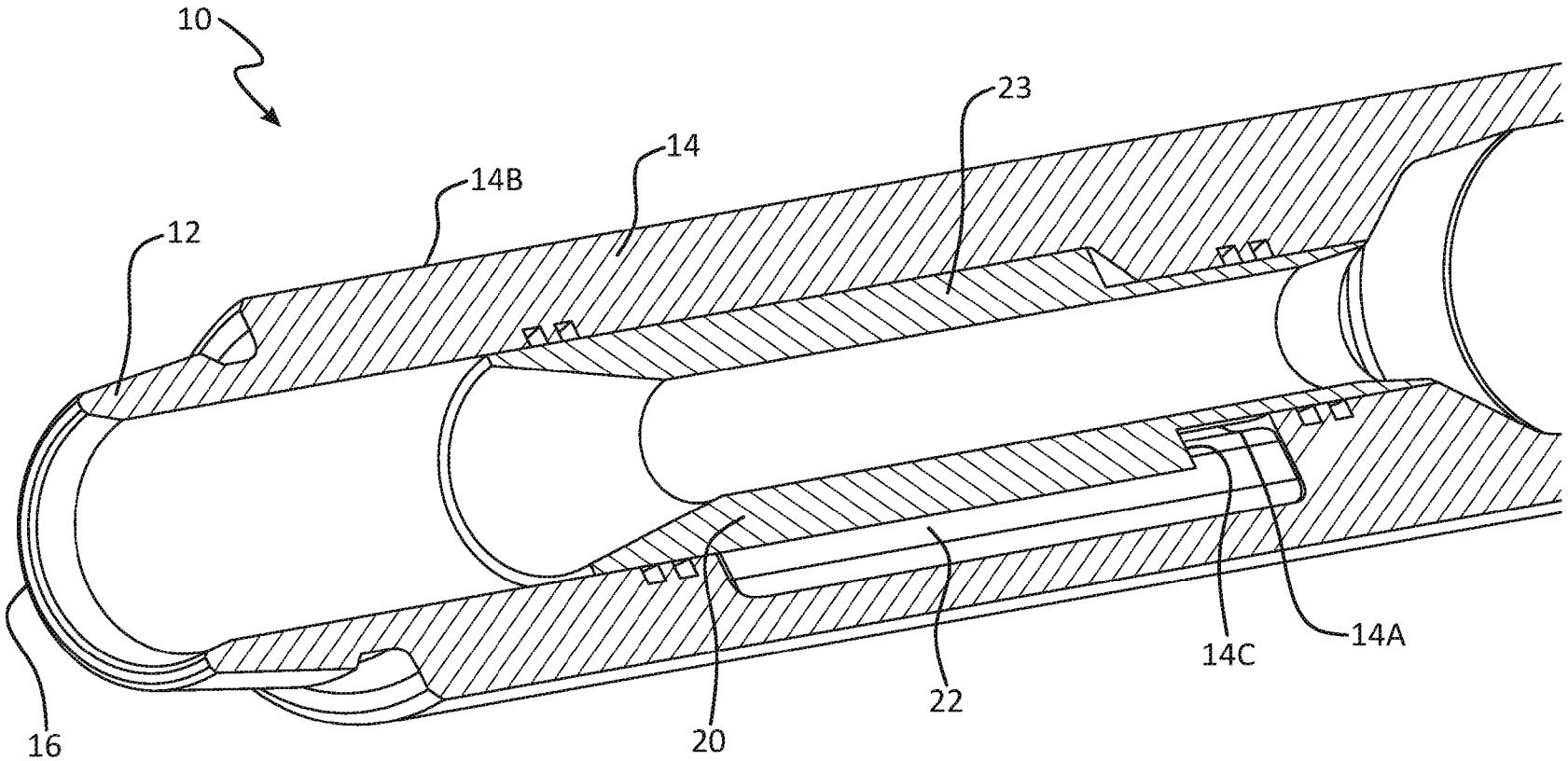
FIG. 1 is a perspective cutaway view of a downhole assembly with a pocket milled out of its internal diameter near the pin end of the downhole assembly.

FIG. 1 shows a downhole assembly 10 of a drill string (not shown). The apparatus described herein is not specific to any particular type of drilling operation. Downhole assembly 10 comprises a collar 14 having a pin end 12 and a box end 10A (see FIG. 2). Collar 14 may be coupled into a drill string by way of suitable couplings on pin end 12 and box end 10A. The couplings may for example comprise API threaded couplings. Collar 14 has an inner diameter 14A and an outer diameter 14B. Inner diameter 14A defines a bore 16 which is typically filled with drilling fluid (not shown) when collar 14 is in use. The drilling fluid is pumped from the surface by a pump (not shown) through bore 16 in the drill string to facilitate in the drilling operation.

A section 20 of collar 14 is configured such that a pocket 22 is formed in inner diameter 14A of collar 14. The size of pocket 22 may be related to inner diameter 14A. Where collar 14 has a larger inner diameter 14A, pocket 22 may have a larger width than would be possible where collar 14 has a smaller inner diameter 14A. In directional drilling applications a pocket 22 may be given a particular orientation relative to the drill string. For example, pocket 22 may be located on the highside of collar 14.

Figure 7:
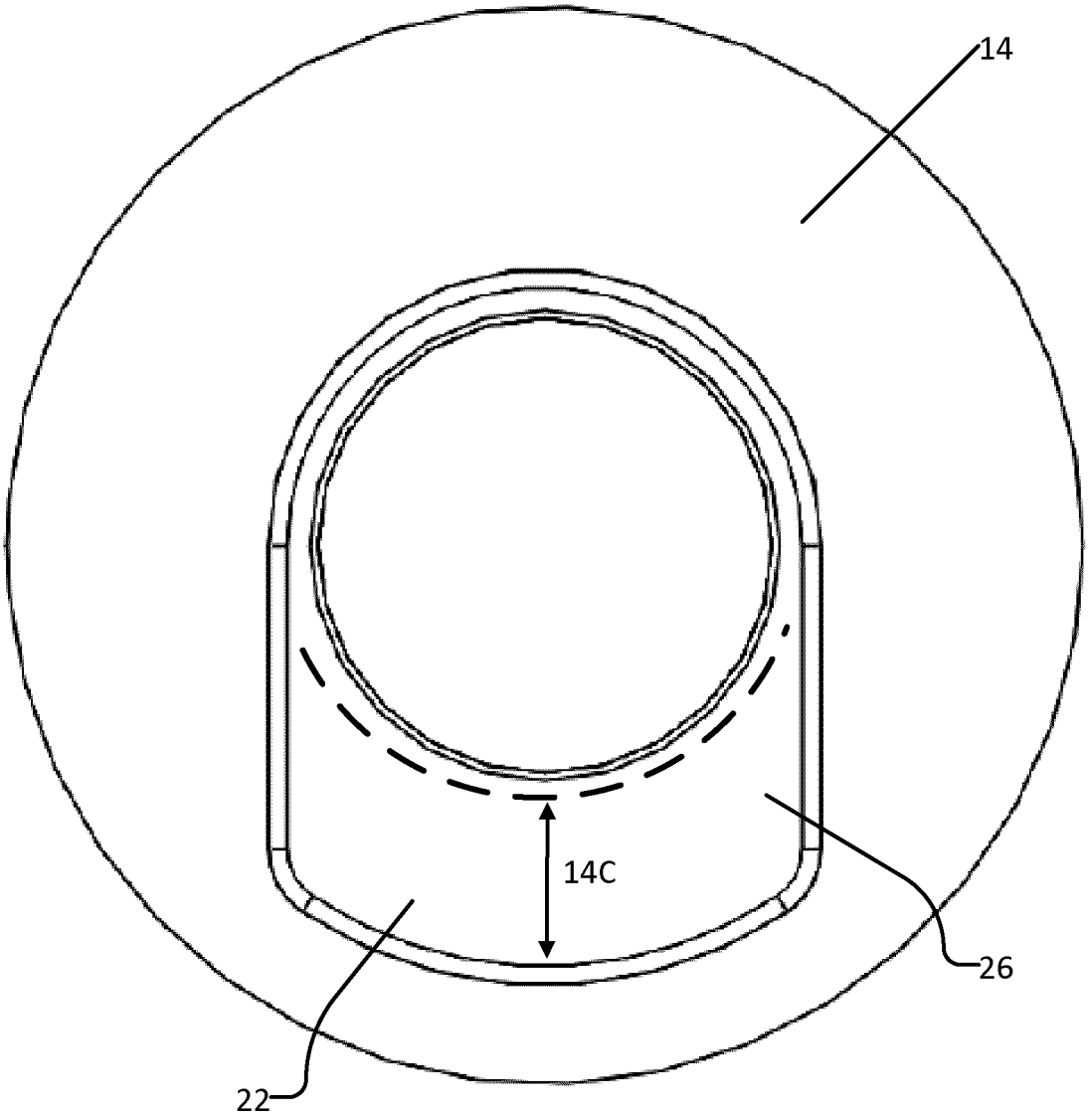
FIG. 7 is a cross sectional view of the downhole assembly in FIG. 2 taken along plane 2A-2A.
Figure 8:
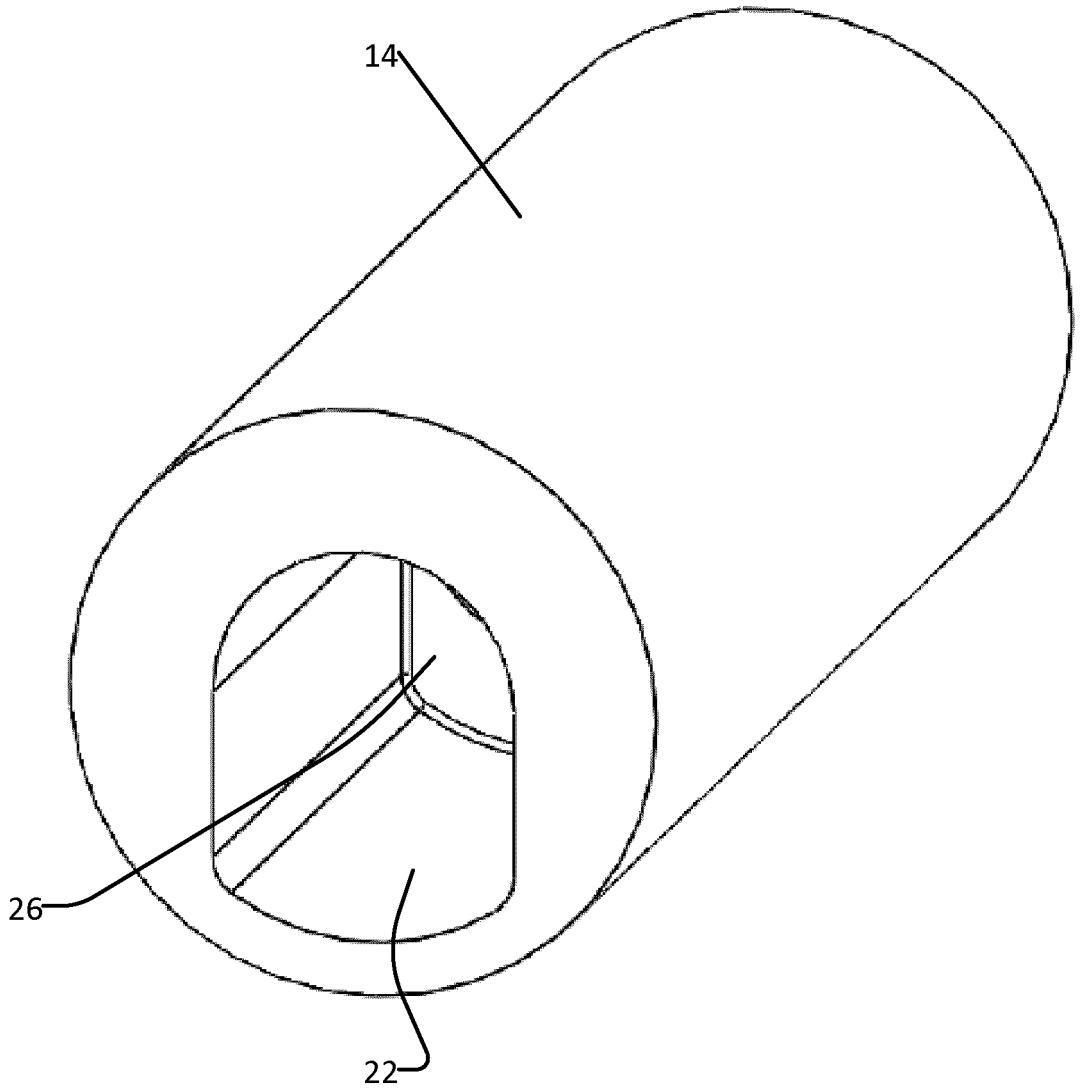
FIG. 8 is a perspective cutaway view of the downhole assembly in FIG. 7.

Pocket 22 may be formed in different shapes. For example, pocket 22 may be milled out from inner diameter 14A in the form of a semi-circle having a depth 14C (see FIGS. 7 and 8). Pocket 22 may be formed near pin end 12 or box end 10A (see FIG. 2). Pocket 22 may also be formed anywhere along collar 14. Independent of its shape, pocket 22 is formed to have wall thickness capable of handling pressures expected in operation. For example, walls of pocket 22 may be designed to withstand pressure differentials on the order of 20,000 psi differential for deep drilling operations. The wall thickness of pocket 22 may vary depending on factors such as the outer diameter of collar 14 dimensions of pocket 22 and the inner diameter of bore 16.

In some embodiments, pocket 22 has parallel sides that extend longitudinally along collar 14. The planes or the parallel sides may be spaced apart equally on either side of the longitudinal centerline of drill collar 14. With this configuration, an electronics package shaped to conform with pocket 22 can be moved radially into pocket 22 from bore 16.

In an example preferred embodiment, pocket 22 is formed near box end 10A. In general, box end 10A has a larger opening than pin end 10B and so it may be possible to more easily insert a larger electronics package through box end 10A than would be possible through pin end 10B. Pocket 22 may have any suitable length. By way of non-limiting example, pocket 22 may be 12", 20" or 24" long. In some embodiments the ends of pocket 22 are flat. These ends may extend in planes perpendicular to the longitudinal centerline of collar 14.

In some embodiments, the bottom of pocket 22 comprises a cylindrical surface having a center of curvature on the longitudinal centerline of collar 14. In cross section at least a major portion of the bottom of a pocket 22 configured in this manner follows an arc centered on the longitudinal centerline of collar 14. In such an embodiment a thickness of the wall on the bottom of pocket 22 may be constant. The wall thickness may be relatively small compared to the wall thickness of other parts of collar 14. For example, in some embodiments the thickness D of the wall at the bottom of pocket 22 is less than about 0.125 inches. In some embodiments this thickness is in the range of about 0.125 inches to about 0.30 inches. In some embodiments, this thickness is less than ½ or less than ¼ and/or less than ⅛ of a thickness of the wall of collar 14 away from pocket 22.

A pocket 22 may be formed in collar 14 without significantly reducing the strength of collar 14 since the length of pocket 22 can be relatively small compared to the length of collar 14 and pocket 22 typically extends less than ½ way around collar 14. For example, as measured relative to the longitudinal centreline of bore 16, a pocket 22 may extend through an angle of less than 180° or possibly less than 120° or in some cases less than 90°.

Pocket 22 may accommodate an electronics package. The electronics package may have a shape that conforms with pocket 22 such that the electronics package substantially fills pocket 22. Here, the term "electronics" encompasses any active mechanical, electronic, and/or electromechanical system, battery or power source as well as gamma modules or other sensor packages. In the illustrated embodiment, the electronics package is in the form of a holster 24, as can be seen in FIGS. 3, 5, 6, and 9 to 12.

A holster 24 comprises a body having outer surfaces configured to fit into pocket 22. Holster 24 has internal chambers configured to receive one or more housings containing electronics. In such embodiments, the holster 24 may provide a convenient way to package one, two, or more housings containing electronics into a single unit that can quickly and securely be installed into pocket 22. Holster 24 may provide one or more of vibration damping for the electronics, adopting the electronics to fit into pocket 22, supporting the electronics in a desired location in pocket 22, shielding the electronics from radiation incident from certain directions, etc. Electronics in holster 24 may provide any of a wide range of functions including, without limitation, data acquisition, sensing, data telemetry, control of downhole equipment, status monitoring for downhole equipment, collecting data by way of sensors that may include one or more of vibration sensors, magnetometers, gamma-radiation and nuclear particle detectors, electromagnetic detectors, acoustic detectors, and others, emitting signals, particles or fields for detection by other devices, any combination of these, etc.

Downhole conditions can be harsh. Exposure to these harsh conditions, which can include high temperatures, vibrations, shocks, and immersion in various drilling fluids can shorten the lifespan of downhole probes. Electronics holster 24 may be designed to withstand downhole conditions. In order to avoid pinging between electronic holster 24 and the inside of pocket 22, electronics holster 24 may be made from different material than collar 14. Collar 14 is typically metal. Holster 24 may for example be made of or faced with a material such as plastic, thermoplastic, elastomers or rubber. Electronics holster 24 may also or in the alternative be configured to have a size-on-size fit in pocket 22. For example, in the embodiment described in FIGS. 3 to 12, electronics holster 24 is configured to have a half-ring shape complementary to the semi-circle shape of pocket 22.

Figure 9:
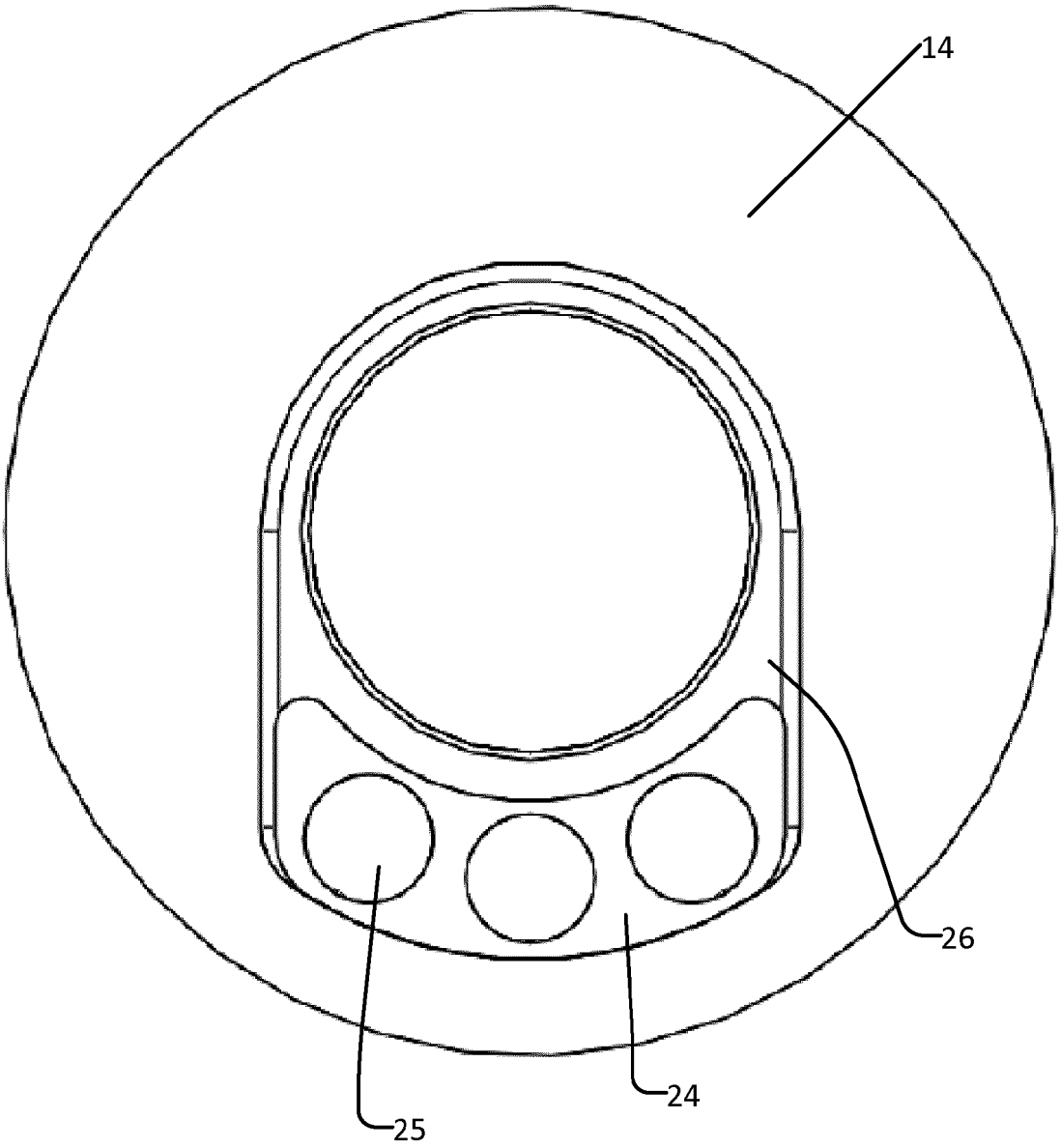
FIG. 9 is a cross sectional view of the downhole assembly in FIG. 3 taken along plane 3A-3A.
Figure 10:
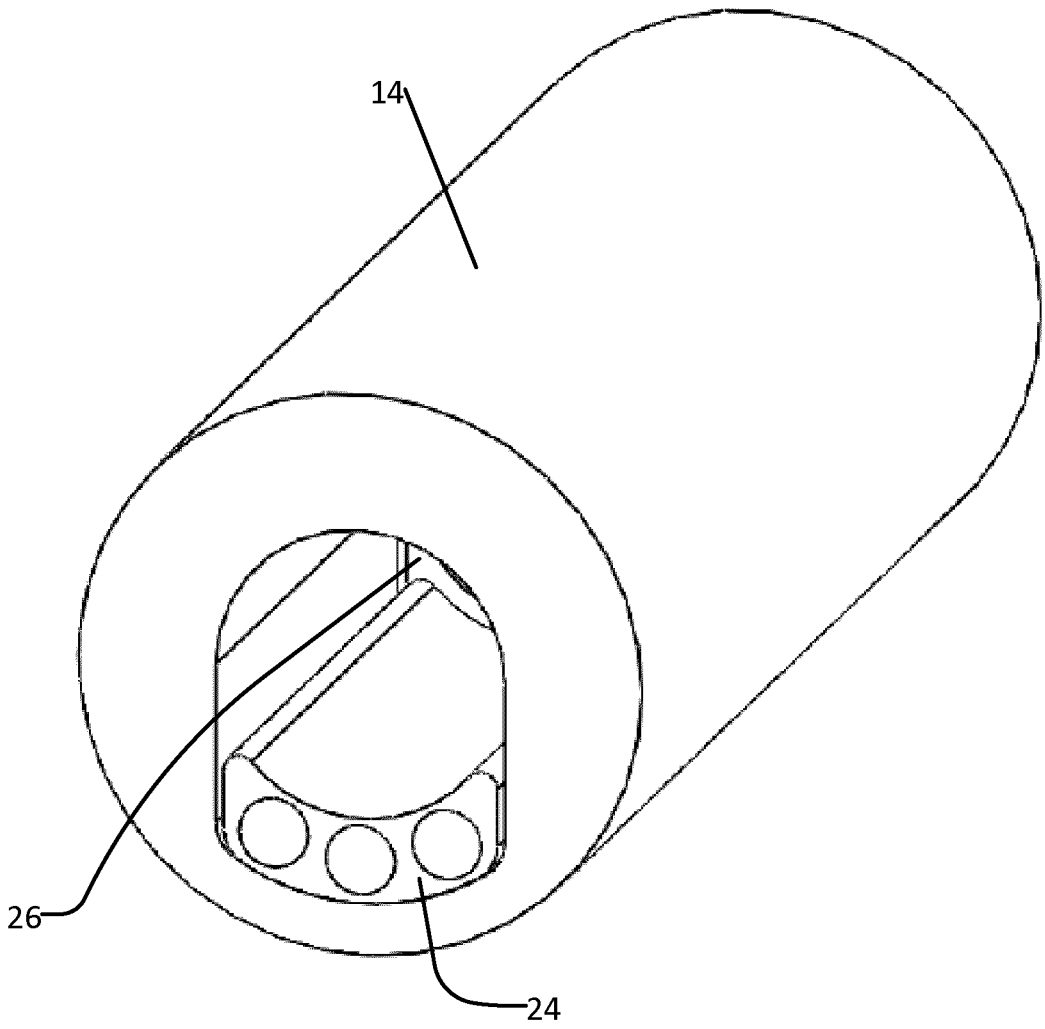
FIG. 10 is a perspective cutaway view of the downhole assembly in FIG. 9.
Figure 11:
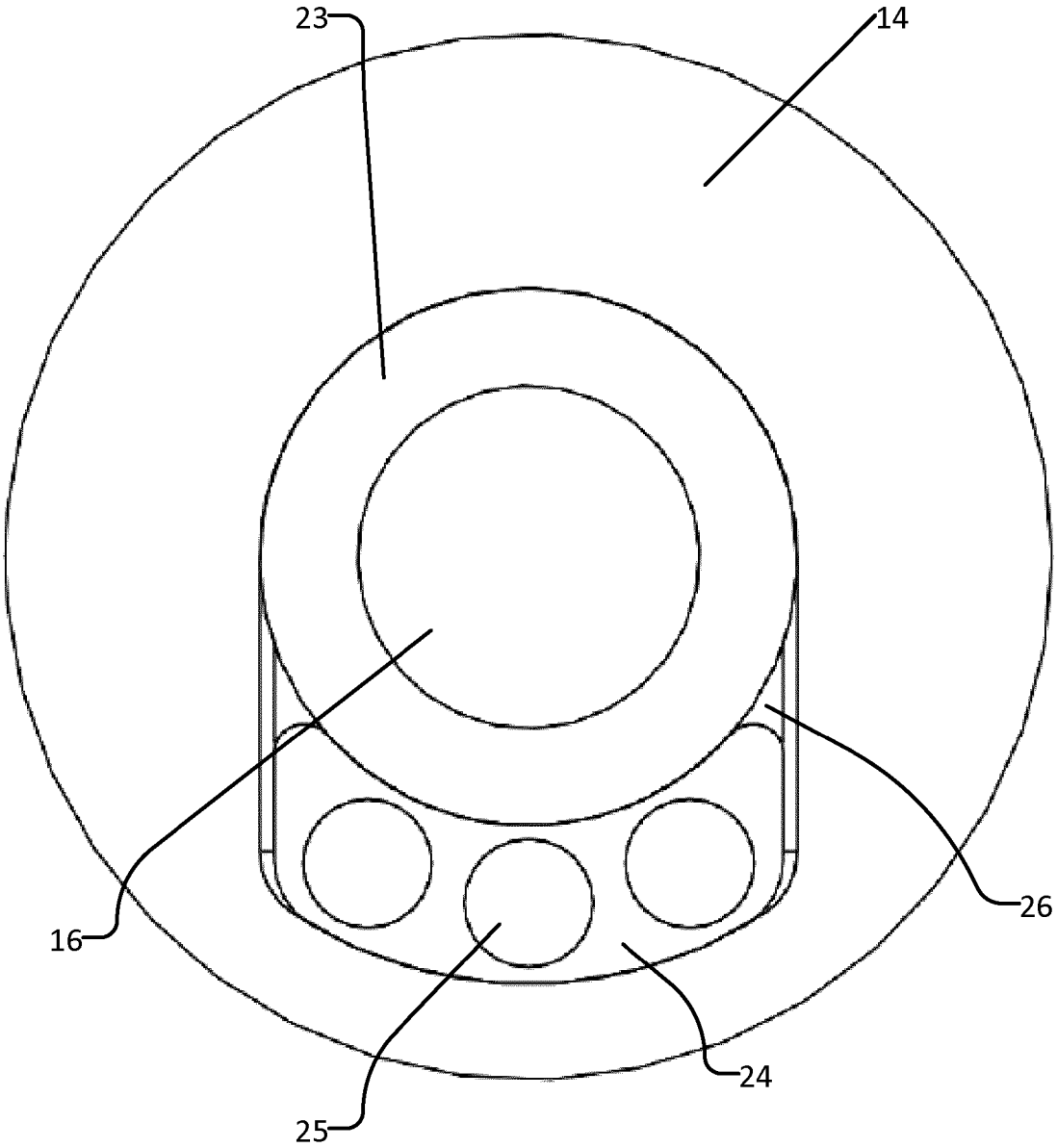
FIG. 11 is the cross sectional view of the downhole assembly in FIG. 9 with a flow sleeve fitted inside the borehole.
Figure 12:
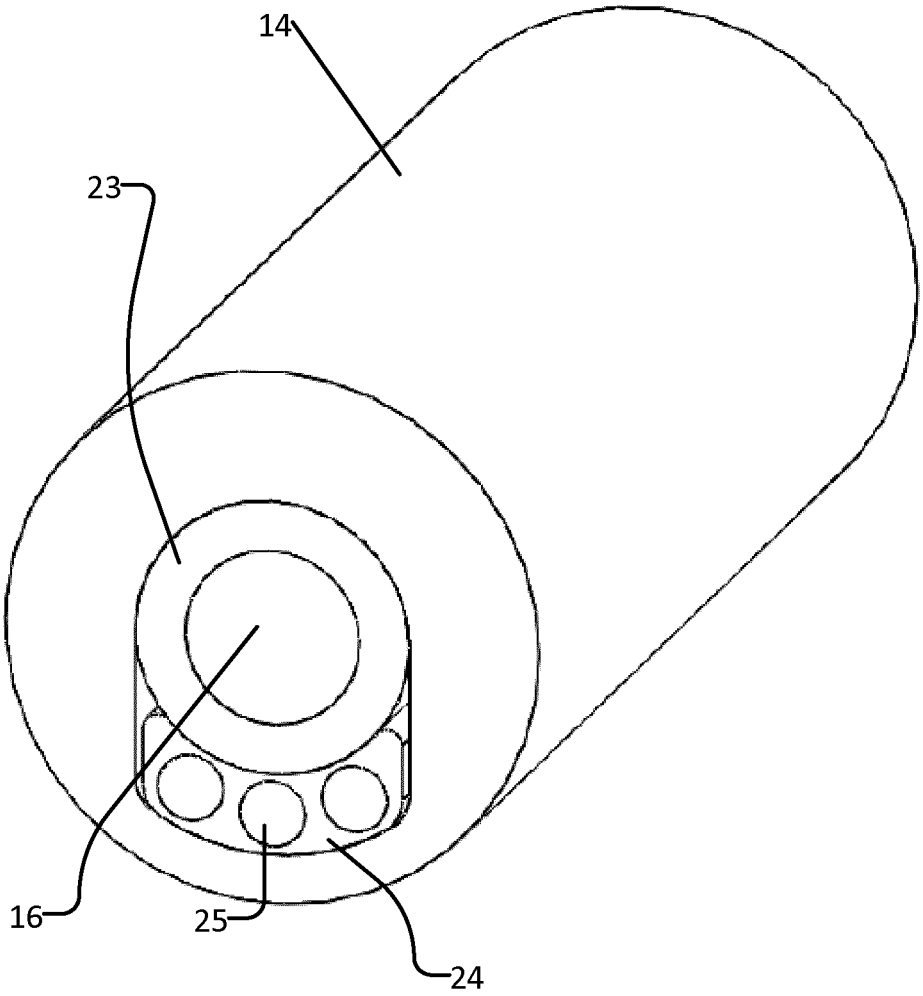
FIG. 12 is a perspective cutaway view of the downhole assembly in FIG. 11.

Electronics holster 24 may be configured to have an inner surface 24A and an outer surface 24B defining a thickness equal to the depth 14C of pocket 22 such that when electronics holster 24 is inserted into pocket 22, inner surface 24A complements and completes the inner surface defined by inner diameter 14A of the bore of collar 14 (see FIGS. 9 and 10). The size of electronics holster 24 is dependent on pocket 22, which in turn is dependent on inner diameter 14A of collar 14.

Pocket 22 may optionally be lined with shock absorbing material such as rubber, elastomer, a soft metal, or the like. Electronics holster 24 may be dimensioned to fit inside the lined pocket 22 with inner surface 24A complementing and completing inner diameter 14A of collar 14. In some embodiments, pocket 22 may be configured to have more than one compartment to house more than one electronics holster or other electronics packages.

Figure 4:
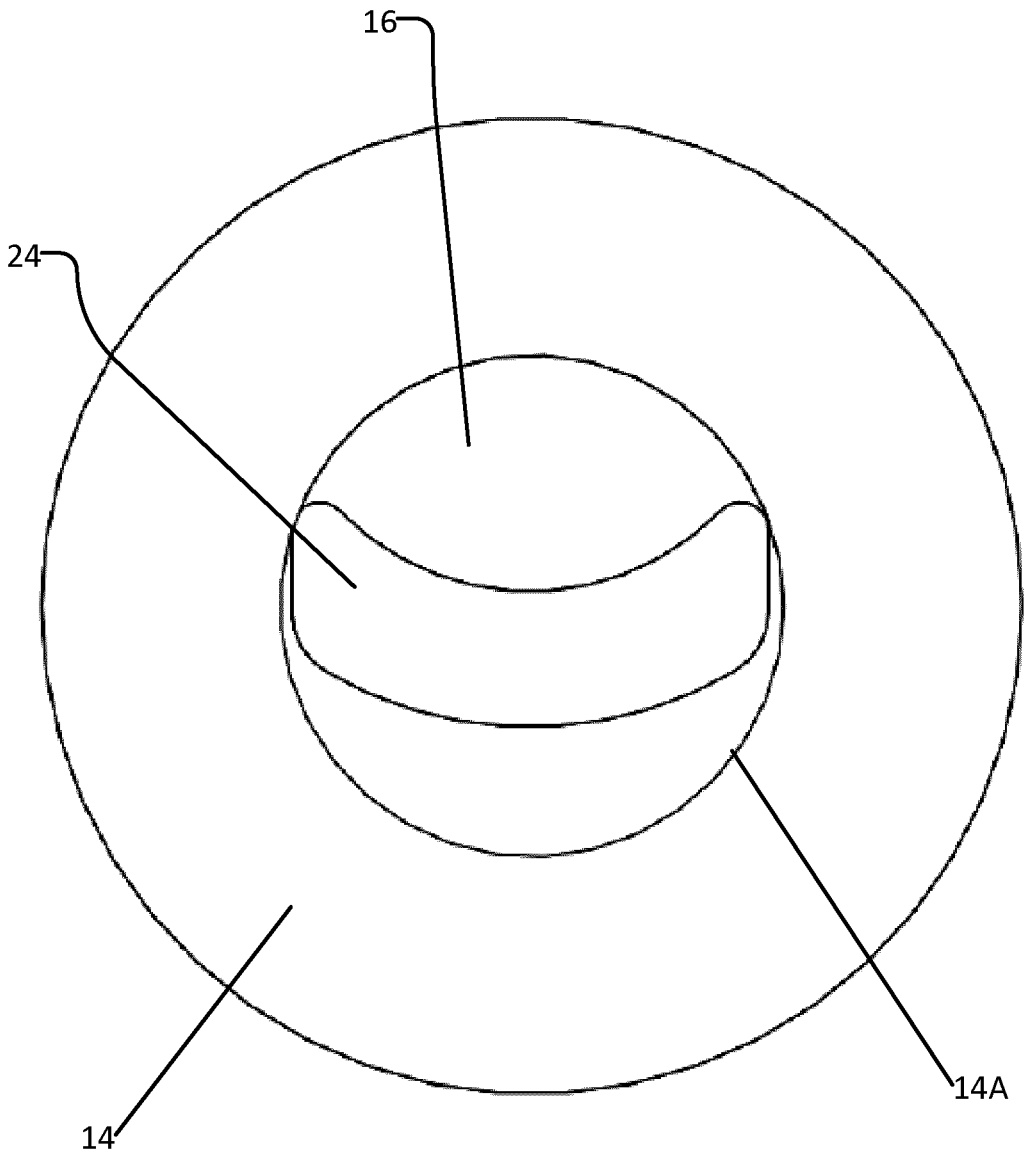
FIG. 4 is a top view of the electronics holster inserted into the bore within the downhole assembly.

FIG. 4 shows an embodiment where the maximum width of electronics holster 24 is slightly less than inner diameter 14A. This figure shows that electronics holster 24 can be relatively large and still fit into the bore of collar 14. Electronics holster 24 or another electronics package can fit into bore 16 as long as its maximum transverse dimension does not exceed inner diameter 14A of bore 16 and as long as the body of the electronics package is suitably flattened. In the assembly of electronics holster 24 into pocket 22, electronics holster 24 is inserted through bore 16 and pushed through bore 16 until it can be moved transversely into pocket 22. Electronics holster 24 may be positioned to line up with pocket 22 before it is inserted into bore 16 or it may be inserted at random and then maneuvered while inside bore 16 until it can be moved into pocket 22.

Electronics holster 24 may comprise one large compartment for housing electronics. The large size of the compartment may enable housing more electronics than a standard probe or it may house a larger number of electronics and/or detectors. For example, in gamma-radiation detection, larger and therefore more sensitive scintillation crystals may be housed within the compartment of electronics holster 24. In addition, the large size of the compartment that may be provided inside electronics holster 24 may allow for use of different types of scintillators such as organic, inorganic, plastic and other types of scintillators. In some embodiments, the large compartment within electronics holster 24 may be used to house sensing electronics, scintillation crystals and/or detectors. Components within electronics holster 24 may play roles in the control of the sensing equipment and/or the drilling operation and/or the logging and processing of sensing data. In some embodiments, electronics within holster 24 cooperate with other downhole systems to provide sensing and/or data telemetry and/or control and/or logging functions. For example, certain functions in holster 24 may be performed in part by components cooperating with components in a probe located within bore 16.

Figure 5:
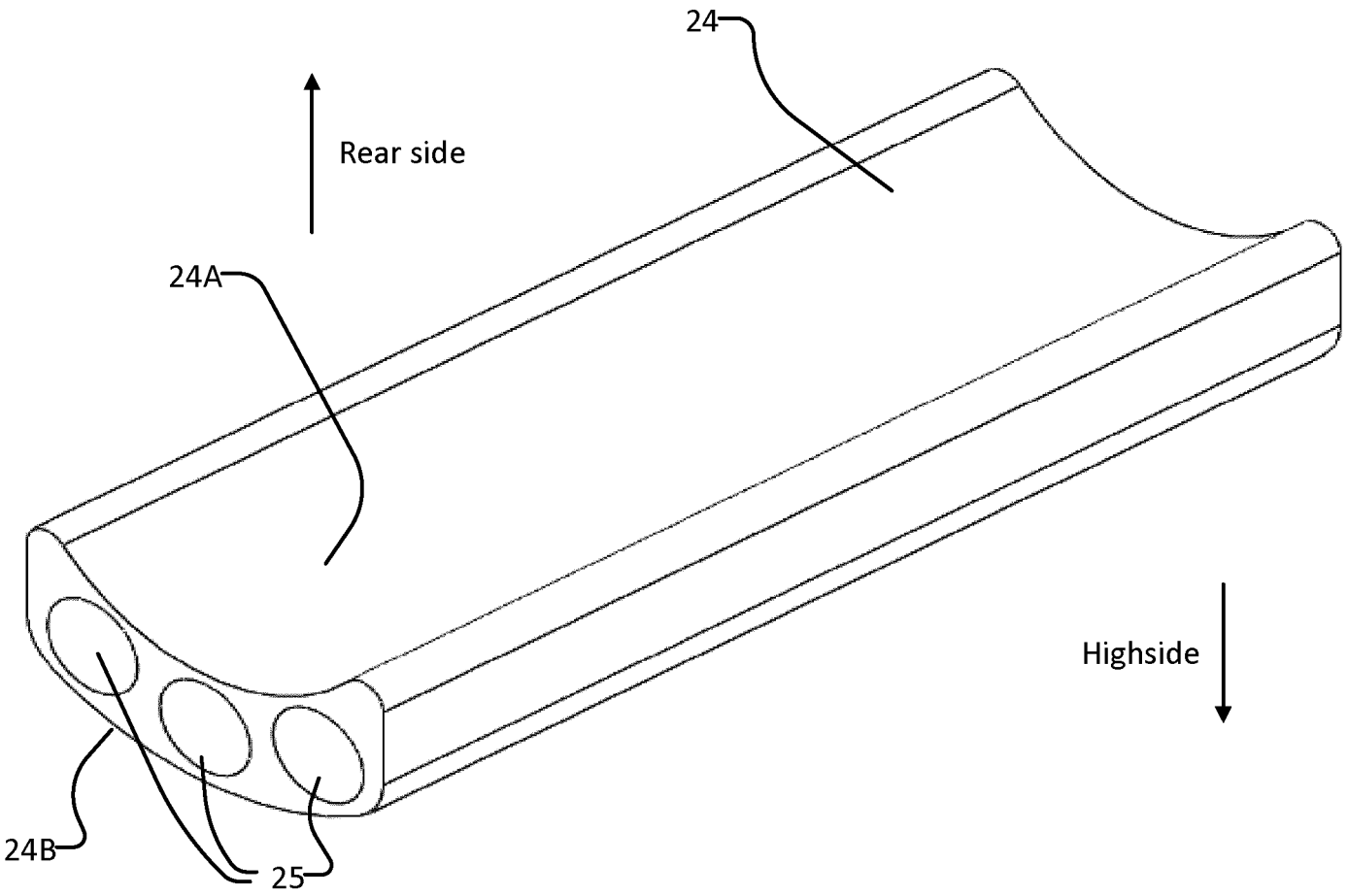
FIG. 5 is a perspective view of an embodiment of the electronics holster.
Figure 6:
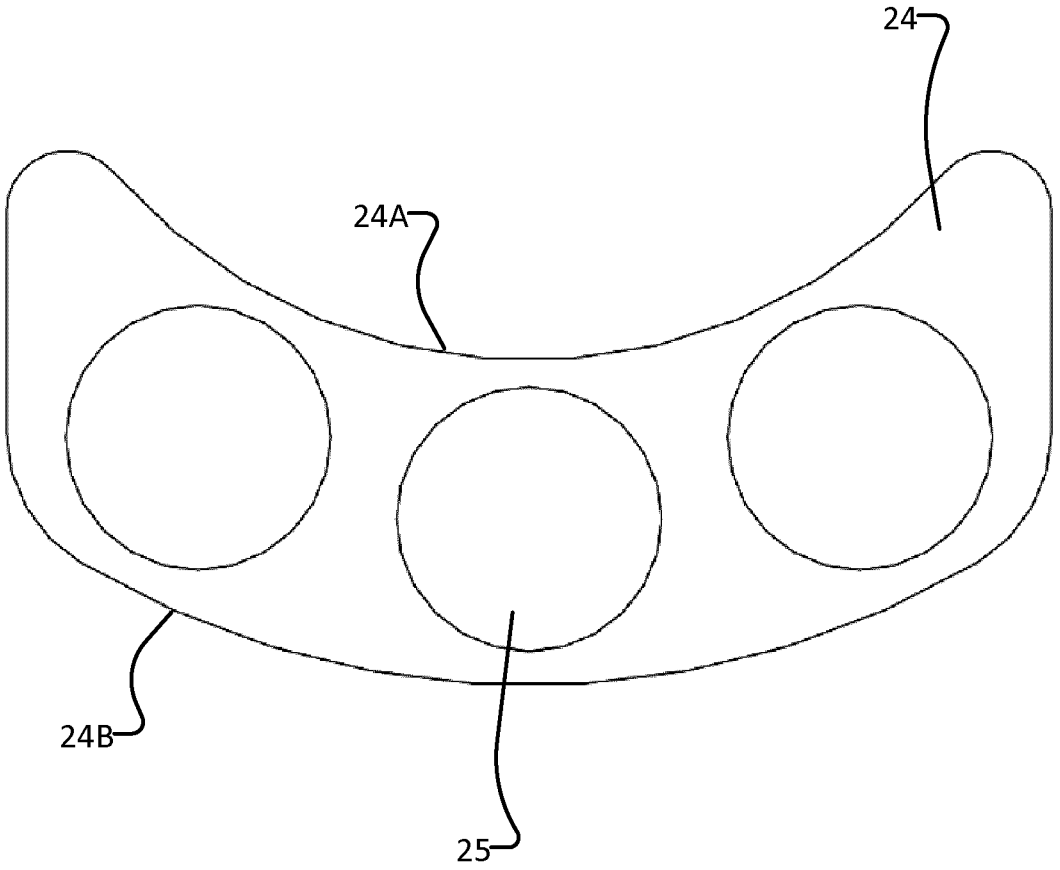
FIG. 6 is a side view of the electronics holster in FIG. 5.

In some embodiments, electronics holster 24 comprises multiple compartments for housing electronics. In some embodiments, electronics holster 24 is pressure rated to withstand high pressures during downhole drilling. In other embodiments, pocket 22 is sealed in such a manner that it is not necessary for holster 24 to be constructed to withstand high pressures. FIGS. 5 and 6 show electronics holster 24 according to an example embodiment of the invention. In this embodiment, electronics holster 24 comprises three compartments 25 of similar size. Each of compartments 25 may also have a size different from the other compartments 25. Each of compartments 25 may be configured to receive a cylindrical or other-shaped housing (not shown) containing similar or different electronics. For example, one or more gamma-radiation scintillators and electronic light sensors such as a photomultiplier tube (PMT) may be placed in compartments 25 such that the circuit for the PMT is placed in one of compartments 25 and a battery which provides electrical power to run the circuit may be placed in another one of compartments 25. In an example embodiment, each of the three compartments 25 may comprise one or more gamma-radiation scintillators and a PMT to provide high-sensitivity gamma radiation detection. In some embodiments, two or more compartments 25 may house the same or similar sensing equipment in order to provide redundant backup.

In some embodiments, electronics within one of compartments 25 may be in electrical communication with electronics in one or more other compartments 25. Electrical connections between electronics in different compartments 25 may be established, for example, by connecting the electronics in different compartments 25 by a wire harness (not shown). In another example embodiment, electronics holster 24 may comprise a backplane, or other electrical connectors arranged such that plugging a housing containing electronics into one of compartments 25 automatically plugs an electrical connector on the housing into an electrical connector in holster 24. The electrical connectors of holster 24 may be interconnected in any suitable manner to establish desired electrical connections and/or optical or other connections between different plugged-in housings. A locking mechanism may be provided to lock housings in their respective compartments 25 in order to prevent axial movement of the housing relative to electronics holster 24 and/or rotational movement of the cylindrical housing within compartment 25.

Provision of an electronics package removably insertable into a pocket 22 in a drill collar 14 can provide a fast and convenient way to install downhole electronics into a drill string. Identical pockets 22 may be provided in drill collars 14 of different sizes to allow the same electronics package to be used in different diameters of drill string as drilling progresses.

Electronics package 24 is held in place in pocket 22. In some embodiments this may be done by means of bolts, pins, or suitable latches. A good way to hold electronics package 24 in place in pocket 22 is to provide a retainer that can be slid into bore 16 to block electronics package 22 from moving radially inwardly from pocket 22. The retainer could, for example, comprise a tubular sleeve.

Figure 13:
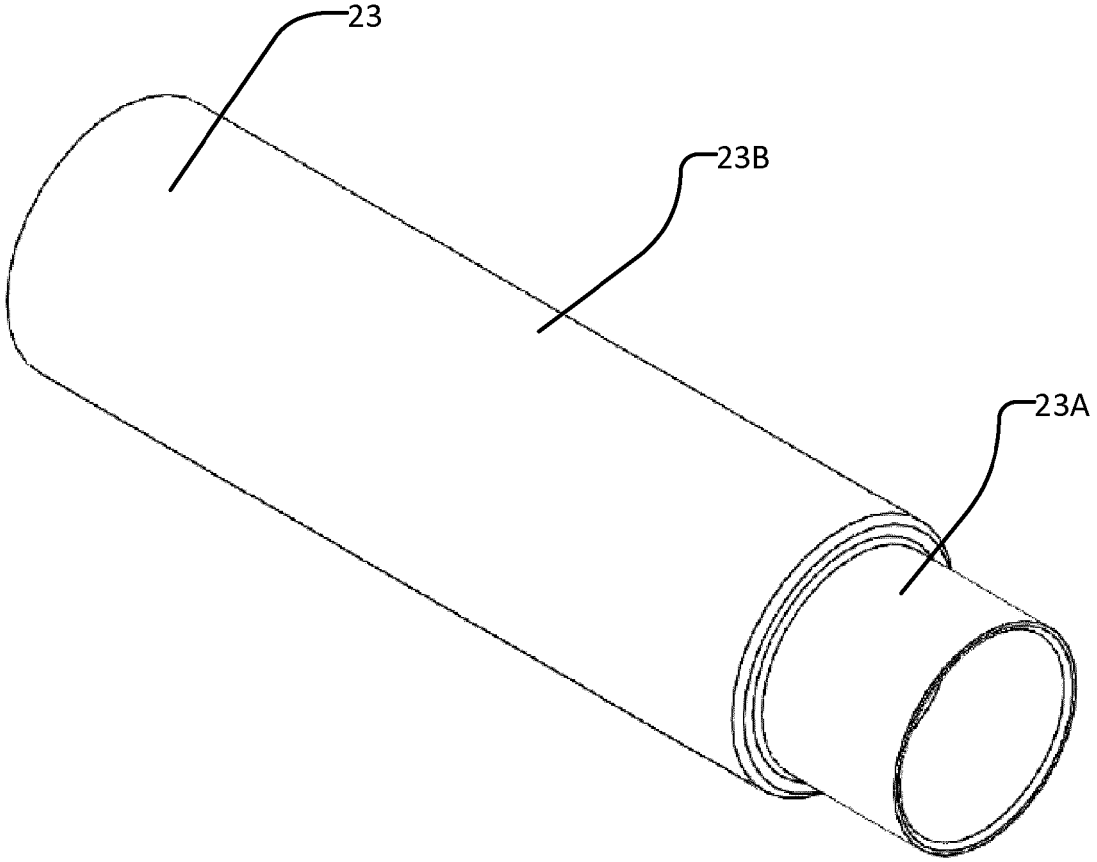
FIG. 13 is a perspective view of the flow sleeve.
Figure 14:
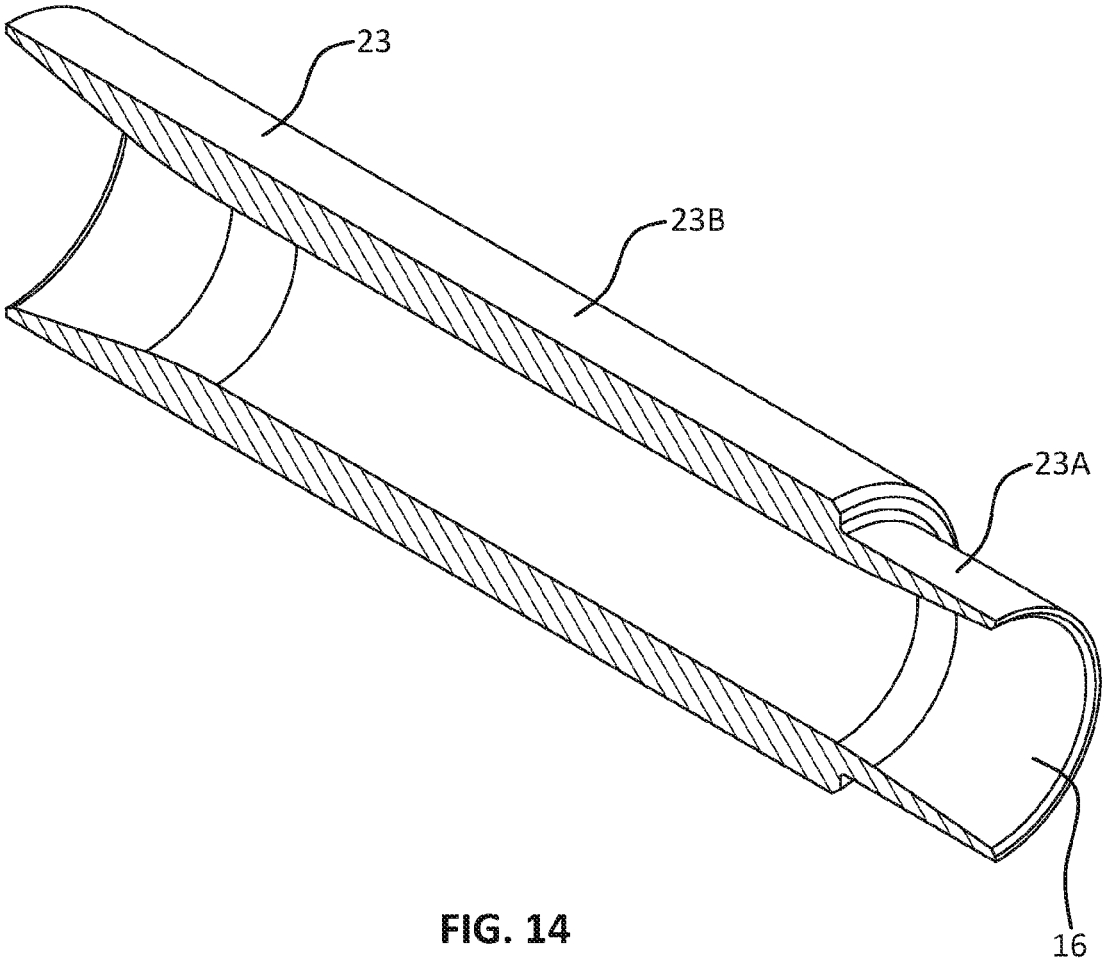
FIG. 14 is a perspective cutaway view of the flow sleeve in FIG. 10.

Returning to FIG. 1, a flow sleeve 23 is shown to have a cylindrical shape and is positioned inside bore 16. Flow sleeve 23 may comprise one cylindrical section with an outer diameter slightly less than internal diameter 14A. Flow sleeve 23 may also have more than one cylindrical section. For example, in the embodiment shown in FIGS. 13 and 14, flow sleeve 23 is shown to have two cylindrical sections 23A and 23B with the outer diameter of section 23B being bigger than the outer diameter of section 23A and the outer diameter of section 23B being slightly less than inner diameter 14A. Flow sleeve 23 may be made from a material the same as or similar to that of collar 14 or may be made from a different material. In some embodiments, flow sleeve 23 is made of a material having a high resistance to erosion and a high density such as tungsten/carbide, which allows it to act as a gamma-radiation attenuation shield and to focus the direction of the gamma radiation received by the scintillation crystal to the highside.

Figure 2:
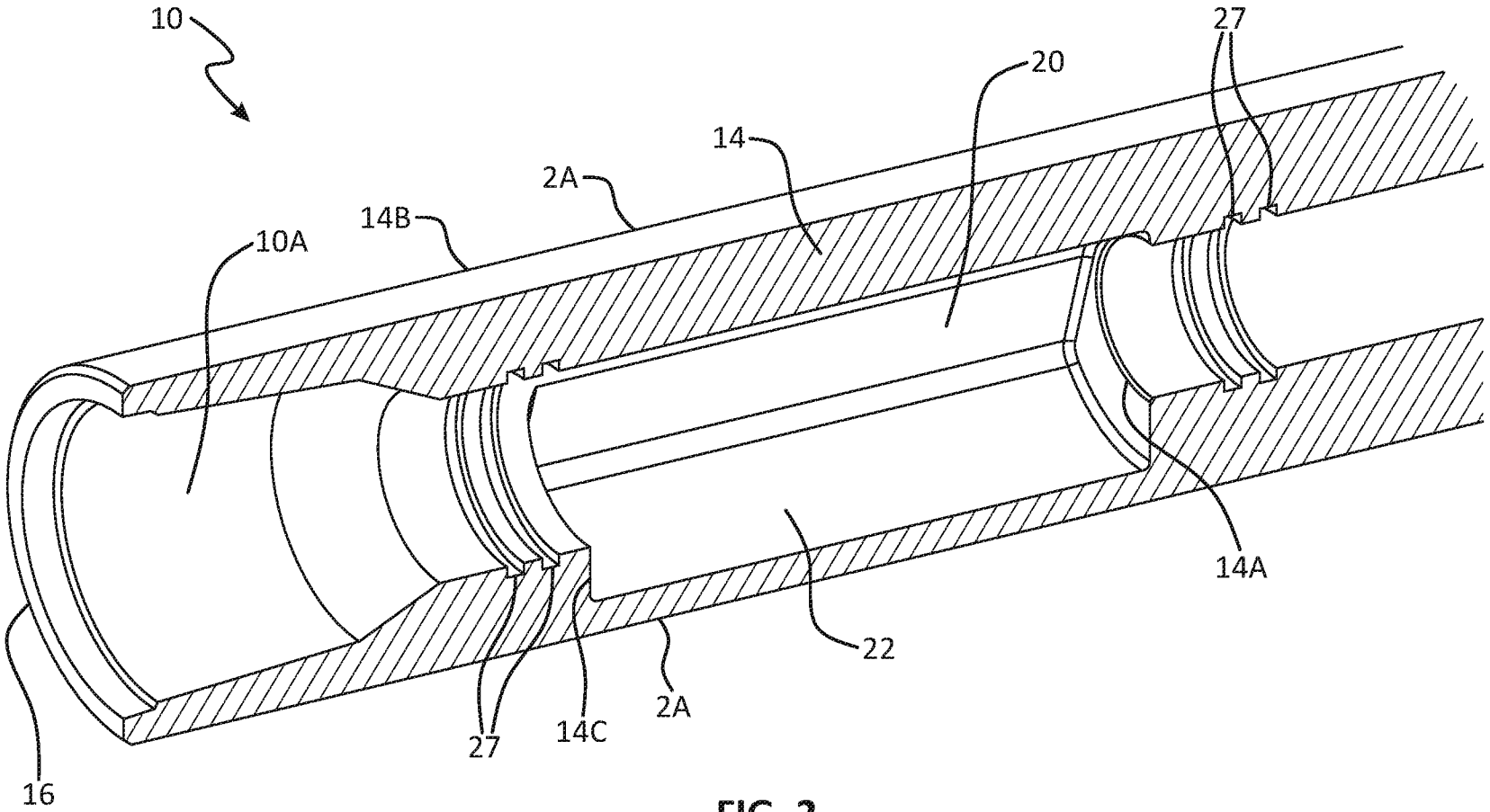
FIG. 2 is a perspective cutaway view of a downhole assembly with a pocket milled out of its internal diameter near the box end of the downhole assembly.
Figure 3:
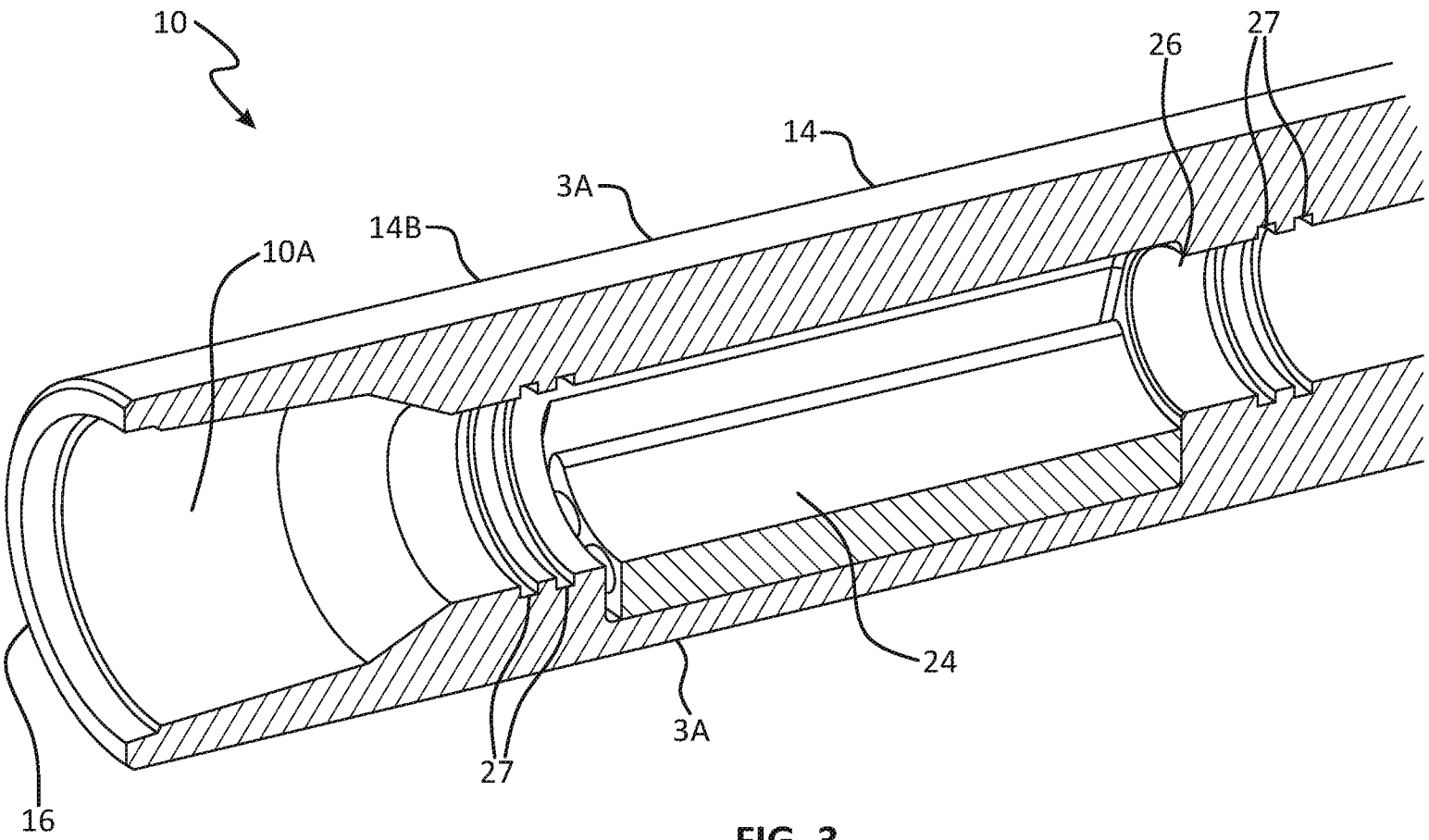
FIG. 3 is a perspective cutaway view of the downhole assembly in FIG. 2 with an electronics holster inside the pocket.

When electronics holster 24 is positioned inside pocket 22, flow sleeve 23 may be inserted through bore 16 until it meets shoulder 26 (see FIG. 2) or another abutment surface that stops flow sleeve 23 from moving further into bore 16. Shoulder 26 prevents flow sleeve 23 from sliding any further into bore 16. As shown in FIG. 2, shoulder 26 is formed on the inner surface of collar 14 and is located in bore 16 past pocket 22. Inner diameter 14A before shoulder 26 is bigger than inner diameter 14A after shoulder 26. When flow sleeve 23 rests against shoulder 26, section 23B of flow sleeve 23 is positioned over pocket 22 so that electronics holster 24 is secured inside pocket 22 and inner surface 24A matches outer diameter of section 23B (see FIGS. 11 and 12).

With sleeve 23 in place, a new section of drill collar may be coupled to downhole assembly 10, such that the pin end of the new section presses against flow sleeve 23 securing it against axial movement within bore 16. Alternatively, the uphole portion of flow sleeve 23 may be held in place in collar 14 by another locking arrangement. A non-limiting example of locking arrangements may be a lock nut or a castle ring.

Figure 15:
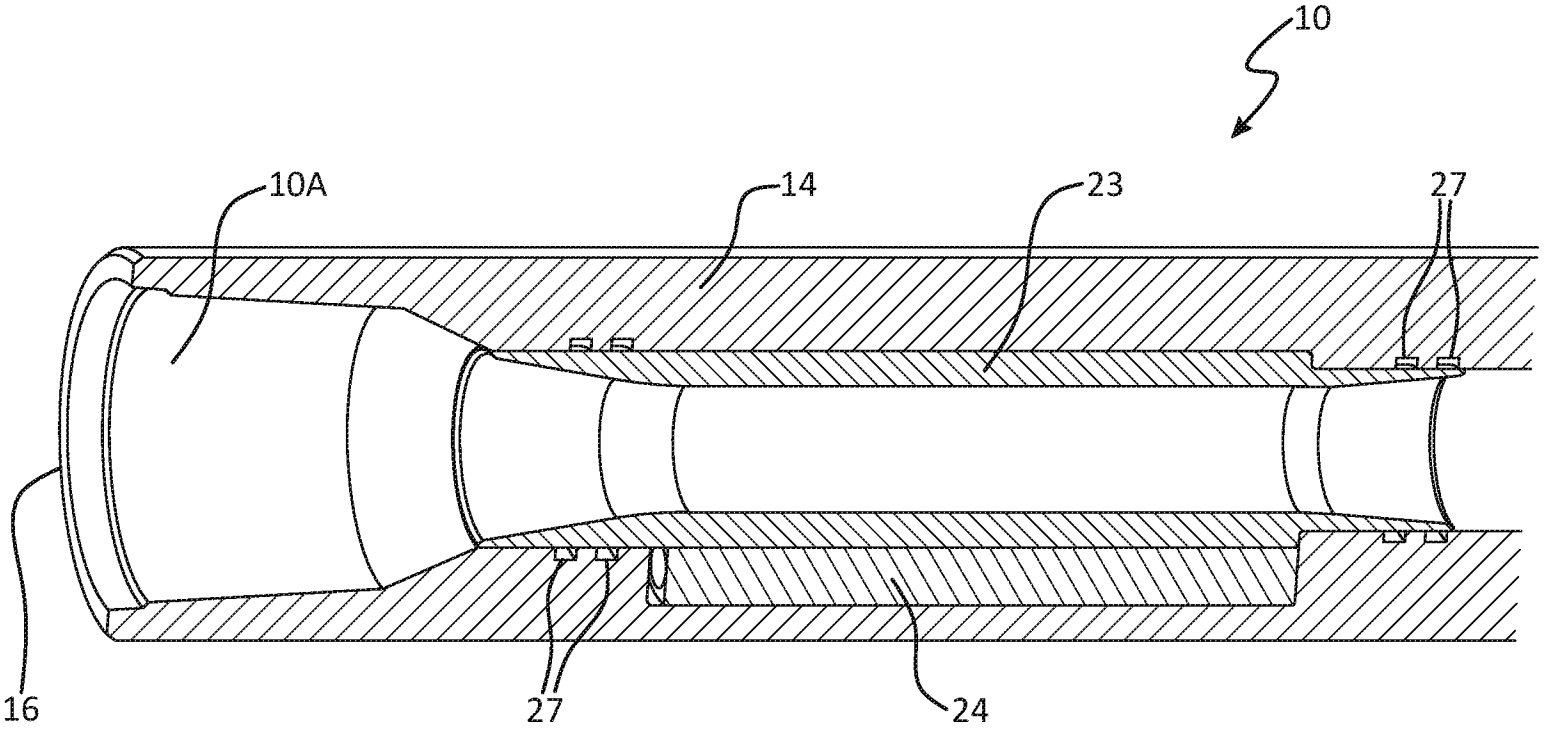
FIG. 15 is a side cutaway view of a downhole assembly according to an embodiment of the invention with the electronics holster and the flow sleeve in place.

Flow sleeve 23 may optionally seal electronics holster 24 from bore 16. This in effect prevents drilling fluid pumped through bore 16 from becoming in contact with electronics holster 24. The sealing may be facilitated, for example, by O-rings 27 that may be received in O-ring grooves in collar 14 or on sleeve 23 (not shown). Such seals may be placed before and after the section 20 of collar 14, which comprises pocket 22 (see FIG. 15). When flow sleeve 23 is inserted inside bore 16, the outer diameter of sections 23B and 23A sealingly engage O-rings 27 on collar 14. Alternatively, flow sleeve 23 may have O-Rings 27 that seal against the inner surface of collar 14. In such embodiment, O-Rings 27 are positioned before and after the part of section 23B that covers pocket 22, so that when flow sleeve 23 is inserted inside bore 16 and section 23B covers pocket 22, O-Rings 27 sealingly engage the inner surface of collar 14.

Providing a gamma radiation detector in an electronics package received in a pocket 22 can be advantageous. One advantage is that gamma radiation incident from the direction of the outer wall of pocket 22 pass through relatively little material of the collar before they are received at the gamma radiation detector. By contrast, gamma-radiation collected by gamma-radiation detectors inside downhole probes centralized inside a bore of a drill collar are typically significantly attenuated in passing through the full thickness of the wall of the drill collar within which the probe is placed. Another source of attenuation for gamma-radiation measurements is the fluid filling the bore of the drill collar and surrounding the downhole probe. By contrast, gamma radiation sensors included in the electronics inside electronics holster 24 can be positioned closer to the formation that is being drilled so that gamma radiation is attenuated less. For example, when gamma scintillators are positioned in pocket 22 which is formed inside collar 14, attenuation is reduced as the gamma radiation does not need to pass through a thick collar wall, the drilling fluid, and probe housing to reach the gamma scintillators. As such, the sensitivity can be much higher and the attenuation factors are reduced.

Conversely, for a gamma radiation detector in pocket 22, attenuation is higher for radiation incident from the rear side of collar 14 as it would have to transfer through the thick side of collar 14 (opposite pocket 22) and drilling fluid before it arrives at the scintillators. In this case, the thick side of collar 14 and drilling fluid may shield against gamma-radiation incident from the rear side of collar 14. The shielding may be strengthened in some embodiments. For example, sleeve 23 may be made from a high density material to act as a shield against gamma radiations incident from the rear side of collar 14. Also, the thick side of collar 14 opposite pocket 22 may comprise added heavy density material that acts as a shield against gamma-radiation from the rear side of collar 14. Furthermore, in FIG. 5, inner surface 24A of electronics holster 24 may be made from or layered with a heavy density material to act as gamma-radiation shielding from the rear. Additionally, or in the alternative, the housing(s) housing the gamma radiation detector may be configured such that their side(s) facing the rear side of collar 14 is/are made from heavy density material that acts as shielding against gamma-radiation incident from the rear side of collar 14.

In such embodiments, the detection of gamma radiation can be made strongly directional (e.g. the gamma detector in the assembly can have a high highside to rear side gamma detection ratio or a front to back ratio).

In some embodiments electronics comprising a gamma radiation detector is non-removably mounted in a pocket 22. To obtain some advantages by providing a gamma detector within a drill collar but located such that the gamma radiation detector is separated from an outer surface of the drill collar by only a relatively thin layer of material does not require other details of construction as described herein. However, such other details of construction or any combination or sub-combination of them may optionally be provided in combination with such a gamma radiation detector.

In some embodiments, an electronics holster 24, placed within pocket 22 is used in combination with a downhole probe centrally located inside bore 16. For example, electronics holster 24 may be used to house gamma-radiation detectors and other sensors. Electronics holster 24 may also be used to house electronics or electro mechanical systems that would not otherwise fit inside the probe or that may require close proximity to the formation or the outer drill collar wall to measure a variable. The probe may, for example, provide one or more telemetry systems. Electronics holster 24 (or another electronics package in pocket 22) may be in data communication with the probe. In some embodiments the data communication may be bidirectional. For example, the probe may provide downlink telemetry commands from the surface to electronics holster 24 and electronics holster 24 may provide sensor data to the probe for transmission to the surface. Such data communication may be carried by acoustic and/or electromagnetic signals and/or by wired connections and/or optical connections for example.

Figure 16:
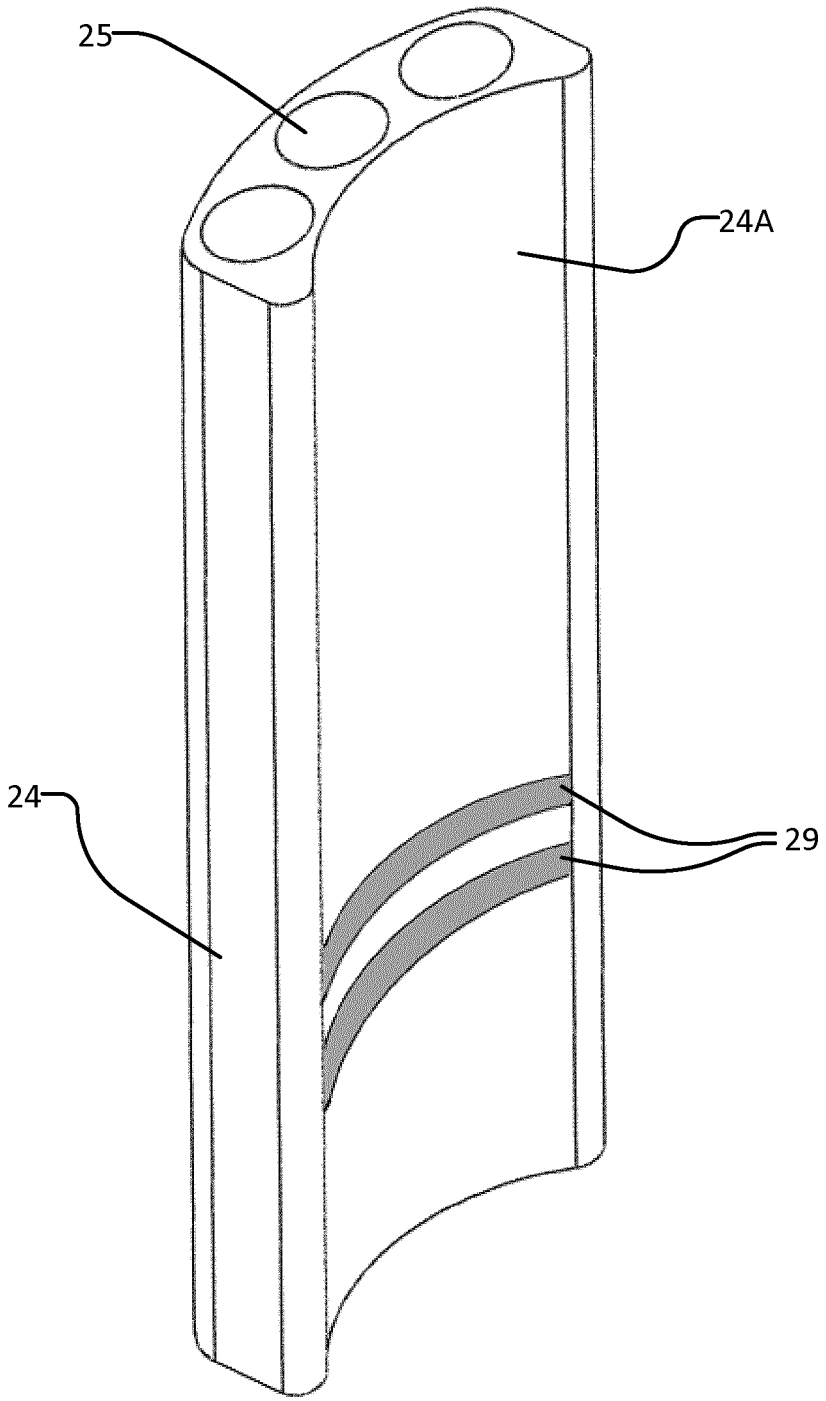
FIG. 16 is a perspective view of an electronics holster according to an example embodiment of the invention.
Figure 17:
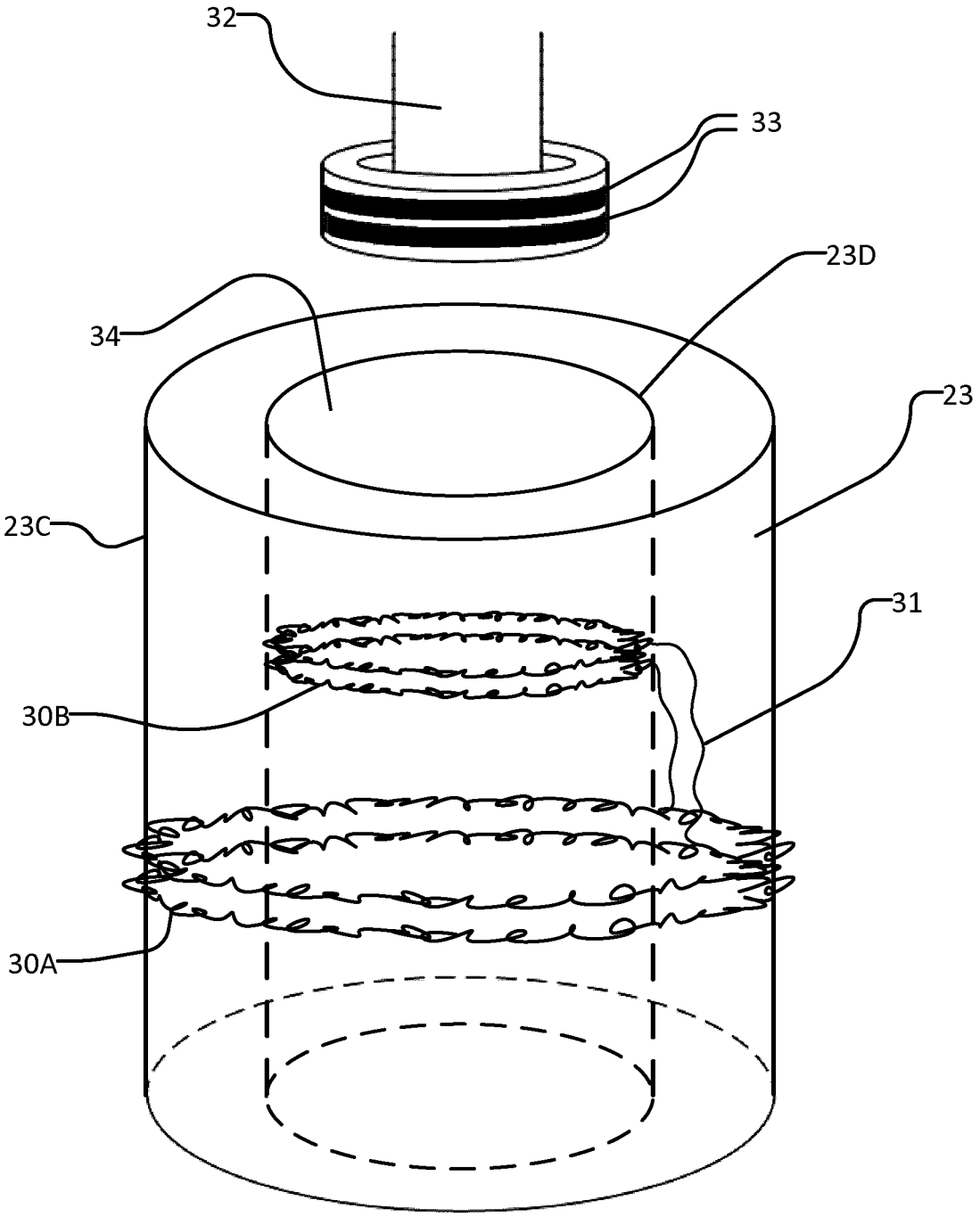
FIG. 17 is a schematic view of a flow sleeve according to an example embodiment of the invention.

In some embodiments, flow sleeve 23 is configured to serve as an electrical connection block to connect electronics in pocket 22 to a telemetry system or other downhole system. FIGS. 16 and 17 schematically show an example embodiment of electronics holster 24 and flow sleeve 23, respectively. Inner surface 24A of electronics holster 24 is equipped with electrical contacts which, in the illustrated embodiment, comprise electrically conducting bands of metal 29 electrically insulated from the body of electronics holster 24 and from each other. In addition, flow sleeve 23 is equipped with corresponding electrical contacts which, in the illustrated embodiment, comprise electrical connection springs 30A insulated from each other and from flow sleeve 23. Springs 30A are located on the outer diameter 23C of flow sleeve 23 in positions corresponding to electrically conducting bands of metal 29.

When flow sleeve 23 is secured against the pocket(not shown in FIGS. 16 and 17), electrically conducting bands of metal 29 on inner surface 24A contact electrical connection springs 30A on outer diameter 23C of flow sleeve 23. The signals are carried to another downhole system by conductors 31.

In the illustrated embodiment, sleeve 23 comprises a second set of electrical conductors (shown as electrical contact springs 30B). This second set of electrical conductors may make electrical connectors to carry electrical power and/or data and/or control signals between holster 24 and a probe 32 located in bore 16. Electrical connection springs 30B are located on the inner diameter 23D of flow sleeve 23 and electrically insulated from each other and from flow sleeve 23. Electrical connection springs 30A and 30B are electrically connected by conductors 31 which are electrically insulated from each other and from flow sleeve 23. Electrical connection springs 30A and 30B may be insulated from flow sleeve 23 by way of an insulating layer (not shown). The insulating layer may be made from any suitable non-conductive material. Electrical connectors 33 located on probe 32 carry the signals from electrical connection springs 30B to probe 32. FIG. 17 shows an example embodiment where electrical connectors 33 are represented by electrically conducting metal bands that are positioned on probe 32 and correspond to electrical connection springs 30B located on inner diameter 23D of flow sleeve 23 when probe 32 is inserted into bore 34 of flow sleeve 23. In some embodiments, probe 32 may be in contact with flow sleeve 23 and/or electronics in holster 24 through wireless means. A similar arrangement may be used to provide electrical power to an electronics package from a probe or downhole generator.

In another embodiment, pocket 22 is formed within collar 14 in a gap sub comprising an electrically insulating joint or connector that divides the drill string into an electrically-conducting uphole section and an electrically-conducting downhole section. The sleeve or a sleeve communication channel or wire may pass through the electrically insulating gap or connection. Conductors in the sleeve may electrically connect first and second terminals provided on the electronics package respectively to the uphole and downhole sections of the drill string. A voltage is driven between the two conductive sections. Pocket 22 may be formed in the uphole portion or the downhole portion of the gap sub. Electronics in electronics holster 24 communicate across the gap by voltage modulation across the gap, which in turn is communicated to a telemetry tool and communicated to the surface.

Apparatus as described herein may be applied in a wide range of subsurface drilling applications. For example, the apparatus may be applied to support downhole electronics that provide telemetry in logging while drilling ('LWD') and/or measuring while drilling ('MWD') telemetry applications. The described apparatus is not limited to use in these contexts, however.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification shall refer to this specification as a whole and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back" , "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole assembly comprising:

a drill collar section having a longitudinally-extending through bore and at least one of a box coupling and a pin coupling;

a pocket opening into the bore, the pocket formed in an inner surface of the drill collar section;

an electronics package located in the pocket; and a sleeve snugly fitted inside the bore;

wherein the sleeve secures the electronics package in the pocket.

2. A downhole assembly according to claim 1 wherein the drill collar section comprises a box coupling and the sleeve is insertable into the bore through the box coupling.

3. A downhole assembly according to claim 1 wherein the bore includes an abutment surface that engages a surface of the sleeve to limit travel of the sleeve into the bore.

4. A downhole assembly according to claim 3 wherein the abutment surface comprises a shoulder between a first portion of the bore having a larger diameter and a second portion of the bore having a smaller diameter.

5. A downhole assembly according to claim 3 wherein an outside of the sleeve comprises a step between a larger-diameter portion of the sleeve and a smaller-diameter portion of the sleeve and the step of the sleeve engages the abutment surface of the bore when the sleeve is fully inserted into the bore.

6. A downhole assembly according to claim 1 wherein the electronics package has a shape complementary to a shape of the pocket.

7. A downhole assembly according to claim 1 wherein the electronics package has a cross-section having an inner face with a radius of curvature matching an outside radius of the sleeve.

8. A downhole assembly according to claim 7 wherein the pocket has a concave outer wall and the cross section of the electronics package has a convex outer face shaped to conform with the outer wall of the pocket.

9. A downhole assembly according to claim 1 wherein the pocket is lined with vibration damping material.

10. A downhole assembly according to claim 1 wherein the electronics package is coated with a vibration damping material.

11. A downhole assembly according to claim 1 wherein the electronics package has a maximum transverse dimension less than a diameter of the bore of the drill collar section such that the electronics package is insertable into the pocket by way of the bore.

12. A downhole assembly according to claim 1 wherein the electronics package comprises:

a holster, the holster comprising a body shaped and dimensioned to fit into the pocket, the body comprising one or more compartments, and a housing received in one of the one or more compartments, the housing containing electronics.

13. A downhole assembly according to claim 12 wherein the holster comprises a plurality of compartments for housing electronics modules.

14. A downhole assembly according to claim 12 wherein the electronics comprise a gamma-radiation detector.

15. A downhole assembly according to claim 12 wherein the electronics comprises a plurality of gamma-radiation detectors.

16. A downhole assembly according to claim 14 wherein the holster comprises a gamma-radiation shielding material between the one or more compartments and the sleeve.

17. A downhole assembly according to claim 14 comprising a high density material in a section on the inner surface of the drill collar opposite the pocket, wherein the high density material covers an area bigger in size than the pocket.

18. A downhole assembly according to claim 1 wherein the sleeve is made from a high density material.

19. A downhole assembly according to claim 17 wherein the high density material comprises tungsten carbide.

20. A downhole assembly according to claim 1 further comprising seals arranged between the sleeve and the drill collar section to seal the pocket from the bore.

21. A downhole assembly according to claim 20 wherein the seals extend circumferentially around the sleeve.

22. A downhole assembly according to claim 20 wherein the seals comprise a first seal located between the pocket and a first end of the drill collar section and a second seal located between the pocket and a second end of the drill collar section.

23. A downhole assembly according to claim 12 wherein the electronics are in electrical communication with a first set of one or more electrical conductors supported on an inner surface of the holster.

24. A downhole assembly according to claim 23 wherein a second set of electrical conductors corresponding to the first set of electrical conductors is supported on an outer surface of the sleeve such that when the sleeve secures the holster inside the pocket, the electrical conductors of the first set are in electrical contact with the corresponding electrical conductors of the second set.

25. A downhole assembly according to claim 24 comprising a third set of electrical conductors supported on an inner surface of the sleeve, wherein one or more of the electrical conductors of the set are electrically connected to a corresponding electrical conductor of the third set.

26. A downhole assembly according to claim 25 further comprising a probe removably inserted into the bore, wherein the probe is in electrical communication with one or more of the electrical conductors of the third set.

27. A downhole assembly according to claim 1 further comprising a probe removably inserted into the bore, wherein the probe is in data communication with the electronics package.

28. A downhole assembly according to claim 1 wherein the sleeve is biased to the collar by biasing means, the biasing means secure the sleeve from axial movement relative to the collar inside the bore.

* * * * *